US006499504B2

(12) United States Patent
Wichert

(10) Patent No.: US 6,499,504 B2
(45) Date of Patent: Dec. 31, 2002

(54) CONTROL SYSTEM FOR CONTROLLING MULTIPLE COMPRESSORS

(75) Inventor: Ernest J. Wichert, Hackettstown, NJ (US)

(73) Assignee: Scales Air Compressor, West Patterson, NJ (US)

( * ) Notice: Subject to any disclaimer, the term of this patent is extended or adjusted under 35 U.S.C. 154(b) by 0 days.

(21) Appl. No.: 10/142,368

(22) Filed: May 9, 2002

(65) Prior Publication Data

US 2002/0170606 A1 Nov. 21, 2002

Related U.S. Application Data

(63) Continuation of application No. 09/684,231, filed on Oct. 6, 2000, now Pat. No. 6,394,120.

(51) Int. Cl.[7] ..... G05D 7/06

(52) U.S. Cl. ..... 137/565.13; 137/565.33; 417/53; 417/286

(58) Field of Search ..... 137/565.33, 565.13, 137/487.5; 417/53, 286

(56) References Cited

U.S. PATENT DOCUMENTS

| | | | | |
|---|---|---|---|---|
| 3,720,487 A | | 3/1973 | Wiley | |
| 3,847,173 A | | 11/1974 | Hill | |
| 4,502,842 A | | 3/1985 | Currier et al. | |
| 4,580,947 A | | 4/1986 | Shibata et al. | |
| 4,621,496 A | | 11/1986 | Lamb | |
| 4,640,665 A | | 2/1987 | Staroselsky et al. | |
| 4,807,150 A | * | 2/1989 | Hobbs | 364/510 |
| 5,108,263 A | * | 4/1992 | Blotenberg | 417/53 X |
| 5,137,079 A | | 8/1992 | Anderson | |
| 5,231,846 A | | 8/1993 | Goshaw et al. | |
| 5,325,884 A | | 7/1994 | Mirel et al. | |
| 5,343,384 A | | 8/1994 | Fisher et al. | |
| 5,586,574 A | | 12/1996 | Smith | |
| 5,632,146 A | | 5/1997 | Foss et al. | |
| 5,713,724 A | | 2/1998 | Centers et al. | |
| 5,967,761 A | | 10/1999 | Mehaffey | |
| 6,233,954 B1 | * | 5/2001 | Mehaffey et al. | 62/175 |
| 6,332,336 B1 | * | 12/2001 | Mirsky et al. | 62/613 |

* cited by examiner

*Primary Examiner*—Kevin Lee
(74) *Attorney, Agent, or Firm*—Blaney Harper Jones, Day , Reavis & Pogue

(57) ABSTRACT

The present invention is a more efficient compressor control system and a more efficient method of operating a multiple compressor system because the method and control system are a function of both the system pressure and the volumetric flow rate capacity of the system. Specifically, a compressor is loaded or unloaded from the compressor system after sensing the actual system pressure and volumetric flow rate capacity. The inventor(s) of the present invention have discovered that it is more efficient to control the compressors upon sensing both the pressure and volumetric flow rate capacity of the fluid. Moreover, controlling the compressor system in response to sensing both the pressure and volumetric flow rate capacity of the fluid insures that the appropriate blend of compressors is loaded to the system in order to produce the most suitable pressure and volumetric flow rate capacity. In other words, the control system of the present invention loads the most appropriate compressors to the system in order to produce the most suitable pressure and volumetric flow rate capacity and minimizes the production of any excessive amounts thereof. Thus, controlling the compressors in response to both a change in pressure and a change in the volumetric flow rate capacity prevents the unwarranted utilization of electrical power, thereby producing a more efficient compressor control system.

16 Claims, 5 Drawing Sheets

CONTROL SYSTEM FOR CONTROLLING MULTIPLE COMPRESSORS

CROSS REFERENCE TO RELATED APPLICATION

This is a continuation of Application No. 09/684,231, filed Oct. 6, 2000, U.S. Pat. No. 6,394,120.

TECHNICAL FIELD

This invention relates to a compressor system and more particularly, to a compressor control system and method of operating a compressor system comprising multiple compressors.

BACKGROUND

Compressed fluids, such as air, are commonly used in an industrial environment and serve as a power source for various machines and tools. The actual demand for such compressed fluids typically fluctuates throughout the course of a standard work day due to the varying load requirements of each machine and tool. In order to fulfill the demand for a wide variation in load level, the system for supplying the compressed fluid typically includes a plurality of various sized compressors. The compressors are usually connected in parallel and/or series in order to produce a total capacity that can adequately satisfy the anticipated demand.

The compressors are typically started in sequence beginning with the smallest sized compressor and ending with the largest sized compressor. Thereafter, the compressors are cycled "on" or "off" (i.e., loaded or unloaded) in response to the pressure demands required by the load(s) within the system. For example, in an industrial environment, the activation of one or more pneumatically powered tools that is connected to a compressed air system results in an outflow of compressed air, thereby reducing the overall system pressure. In order to maintain the desired system pressure, it may be necessary to load another compressor onto the system. Similarly, if a machine requiring compressed air is turned "off", the system will have an over abundance of pressurized fluid, thereby increasing the system pressure. Hence, it may be necessary to unload one or more compressors. The issue, therefore, becomes which compressor should be loaded or unloaded (i.e., added or removed from the compressor system).

A pressure responsive control system typically includes a controller that is wired to measure the system pressure. When the system pressure drops below or climbs above a predetermined pressure set-point, the controller loads or unloads the next available compressor. This process is repeated as often as necessary, or until all of the compressors are either loaded or unloaded, in order to compensate for the change in system demand. Similarly, rather than controlling the compressor system in response to the system pressure, the compressor system could be responsive to a flow sensor that measures the fluid flow.

Whether responding to the system pressure or fluid flow within the system, it may be advantageous to initially sequence the loading and unloading of the compressors in order to produce an electrically efficient compressor system. Particularly, the operator of the system may recognize that the load requirements increase as the day progresses. Therefore, certain compressors are loaded and/or unloaded accordingly such that the pressure capacity of the system increases to satisfy the anticipated load requirements. In other words, the sequence is typically based upon an estimate of the anticipated system demand such that the estimate is close as possible to the actual system requirements. The goal of estimating the actual system demand and loading the appropriately sized compressors is to provide a moderately efficient system by minimizing the unused pressure capacity of the system, thereby minimizing the wasteful use of electrical power.

After initially loading the compressors according to the sequence, the compressors are thereafter loaded and/or unloaded in response to the pressure or fluid flow sensors to more particularly satisfy the demands of the system. In other words, if after the initial sequence of compressors is loaded and the system senses that it requires additional pressure, an additional compressor may be loaded to the system to satisfy the immediate demand. Likewise, if the system senses that it has an over abundant pressure capacity, a compressor may be unloaded to reduce the overall system pressure. Again, in order to produce an efficient compressor system, a compressor having a pressure rating similar to the additional system demand or similar to the over abundant pressure capacity will be selected and loaded or unloaded, respectively, such that total system pressure capacity closely resembles the actual system demand, thereby minimizing the wasteful use of electrical power.

However, controlling the compressor system solely in response to the pressure differential between the actual system pressure and the pressure requirement of the system may be not be as electrically efficient as originally believed. Specifically, although the system may produce fluid with sufficient pressure, the volume of fluid being produced may be inadequate or substantially excessive than what is actually required. Similarly, controlling the compressor system solely in response to a change in fluid flow may not be the most electrically efficient control method because although the system may produce the required volume of fluid, the pressure of fluid being produced may be substantially higher or lower than what is actually required.

Additionally, compressors may require a significant amount of time to produce fluid at their rated pressure capacity and fluid flow rate. Moreover, during such period, the compressors utilize a significant amount of electrical energy, which translates into a high operating cost. Furthermore, upon the compressors attaining their rated capacity, the present control systems do not insure that the appropriate blend of compressors is loaded to the system in order to produce the most suitable pressure and volumetric flow rate capacity. In other words, controlling the compressors in response solely to a change in pressure or fluid flow may produce excessive amounts thereof. These unnecessary quantities of fluid flow and pressure are the by products of the compressors utilizing an over abundance electrical energy. Thus, controlling the compressors in response solely to a change in pressure or fluid flow utilizes an unwarranted amount of electrical power, thereby producing an inefficient compressor control system.

OBJECTS OF THE INVENTION

It is an object of the invention to produce a more efficient compressor control system.

It is an other object of the invention to produce a compressor control system that does not merely control the operation of compressors as a function of the system pressure.

It is a further object of the invention to produce a compressor control system that does not merely control the operation of compressors as a function of the system's volumetric flow rate capacity.

SUMMARY OF THE INVENTION

The present invention is a more efficient compressor control system and a more efficient method of operating a multiple compressor system because the method and control system are a function of both the system pressure and the volumetric flow rate capacity of the system. Specifically, a compressor is loaded or unloaded from the compressor system after sensing the actual pressure and volumetric flow rate capacity of the compressor system.

Moreover, the actual flow rate of the compressor system is compared to the online flow rate capacity, and the set-point pressure is compared to the actual pressure of the compressor system. Upon completing these two comparisons, a determination is made as to which, if any, compressors should be loaded or unloaded. These two comparisons allow the control system to load or unload the compressor that will produce the most efficient compressor system. If the pressure of the compressor system is greater than the pressure set-point and the flow rate for one of the compressors is less than the excess flow rate for the compressor system, that particular compressor will be unloaded from the compressor system. Additionally, if the actual pressure of the compressor system is less than the set-point pressure and the actual flow rate of the compressor system is equal to or greater than the online flow rate capacity of the compressor system, then a compressor will be loaded to the compressor system.

Accordingly, the present invention relates to a method of operating a compressor system having a plurality of compressors, wherein each of the compressors is capable of compressing a fluid at a predetermined volumetric flow rate capacity, the method comprising the steps of establishing a set-point pressure, measuring the pressure of the fluid in the compressor system, measuring the volumetric flow rate capacity of the fluid within the compressor system, determining which of the compressors are operating, determining the online volumetric flow rate capacity, wherein the online volumetric flow rate capacity is equal to the sum of corresponding predetermined volumetric flow rate capacities for each of the operating compressors, determining the excess volumetric flow rate capacity of the compressor system, wherein the excess volumetric flow rate capacity is equal to the online volumetric flow rate capacity minus the measured volumetric flow rate capacity and discontinuing the operation of one of the plurality of compressors upon sensing that the pressure of the fluid in the compressor system is greater than the set-point pressure and the corresponding volumetric flow rate capacity for the compressor is less than the excess volumetric flow rate capacity.

The present invention also relates to another method of operating a compressor system having a plurality of compressors, wherein each of the compressors is capable of compressing a fluid at a predetermined volumetric flow rate capacity, the method comprising the steps of establishing a set-point pressure, measuring the pressure of the fluid in the compressor system, measuring the volumetric flow rate capacity of the fluid within the compressor system, determining which of the compressors are operating, determining the online volumetric flow rate capacity, wherein the online volumetric flow rate capacity is equal to the sum of corresponding predetermined volumetric flow rate capacities for each of the operating compressors, and engaging the operation of one of the plurality of compressors upon sensing that the pressure of the fluid in the compressor system is less than the set-point pressure and the volumetric flow rate capacity of the compressor system is equal to or greater than the online volumetric flow rate capacity.

The present invention also relates to a control system for controlling a compressor system, wherein the control system comprises a plurality of compressors, each of said compressors being capable of compressing a fluid at a predetermined volumetric flow rate capacity and predetermined pressure, each of the compressors emitting an operational signal indicative of whether the corresponding compressor is operating, a pressure sensor for measuring the pressure of the fluid within the compressor system, a flow meter for measuring the volumetric flow rate capacity of the fluid within the compressor system, a controller having a programmed set-point pressure, the controller having a programmed volumetric flow rate capacity and pressure for each of the compressors, the controller receiving the operation signals from the plurality of compressors, the controller determining an online volumetric flow rate capacity, wherein the online volumetric flow rate capacity is equal to the sum of the corresponding predetermined volumetric flow rate capacities for each of the operating compressors, the controller determining an excess volumetric flow rate capacity of the compressor system, wherein the excess volumetric flow rate capacity is equal to the online volumetric flow rate capacity minus the measured volumetric flow rate capacity, the controller sending an unloading signal to one of the plurality of compressors upon sensing that the pressure of the fluid in the compressor system is greater than the set-point pressure and that the corresponding volumetric flow rate capacity for the compressor is less than the excess volumetric flow rate capacity.

The present invention also relates to another control system for controlling a compressor system, wherein the control system comprises a plurality of compressors, each of said compressors being capable of compressing a fluid at a predetermined volumetric flow rate capacity and predetermined pressure, each of the compressors emitting an operational signal indicative of whether the corresponding compressor is operating, a pressure sensor for measuring the pressure of the fluid within the compressor system, a flow meter for measuring the volumetric flow rate capacity of the fluid within the compressor system, a controller having a programmed set-point pressure, the controller having a programmed volumetric flow rate capacity for each of the compressors, the controller receiving the operation signal from each of the plurality of compressors, the controller determining an online volumetric flow rate capacity, wherein the online volumetric flow rate capacity is equal to the sum of the corresponding predetermined volumetric flow rate capacities for each of the operating compressors, the controller sending a loading signal to one of the plurality of compressors upon sensing that the pressure of the fluid in the compressor system is less than the set-point pressure and that the volumetric flow rate capacity for the compressor system is equal to or greater than the online volumetric flow rate capacity.

The foregoing features and advantages of the present invention will become more apparent in light of the following detailed description of exemplary embodiments thereof as illustrated in the accompanying drawings.

DESCRIPTION OF THE PREFERRED EMBODIMENTS

The control system of the present invention is primarily designed for use with a multiple compressor system. However, the control system may be employed to control different types of fluid pumps other than compressors. Consequently, for the purposes of this disclosure, the term "compressor" shall include "pump".

Figure 1:
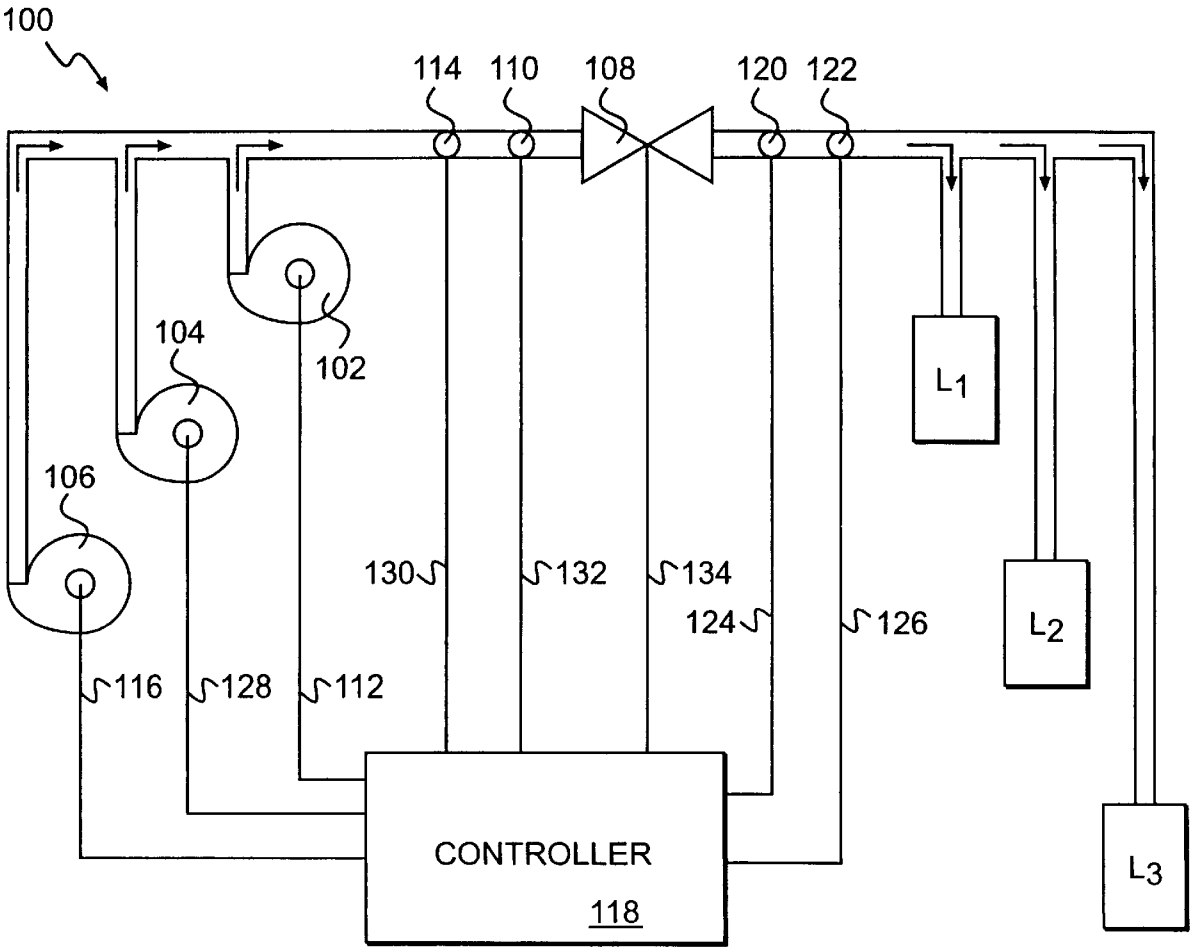
FIG. 1 is a schematic diagram of a compressor system having a controller, a plurality of compressors, a flow control valve, a pressure sensor and a flow meter.

Referring to FIG. 1, there is shown a schematic of a compressor system 100 that supplies compressed air to a plurality of loads identified as $L_1, L_2 \ldots L_n$. The compressor system 100 includes a controller 118, a plurality of compressors 102, 104, 106, a flow control valve 108, a first pressure sensor 114, a first flow meter 110, a second pressure sensor 120, and a second flow meter 122.

FIG. 1 only illustrates three compressors 102, 104, 106. However, it shall be understood that the control system of the present invention is capable of controlling more than three compressors. It shall also be understood that this control system is capable of controlling a variety of different types of compressors, such as reciprocating compressors, rotary-type compressors, centrifugal compressors, etc. Each compressor has a supply (i.e., inlet) manifold and an exit (i.e., discharge) manifold. The fluid enters the supply manifold at a certain pressure and exits the exit manifold at an increased pressure.

Each compressor may have a fixed or variable flow capacity capable of producing fluid, such as air, at a predetermined pressure and volumetric flow rate capacity. Additionally, the compressors may each have the same capacity or different capacities. For the purposes of this disclosure, compressors 102, 104, 106 shall be fixed capacity compressors, and two of the three compressors shall have an equal capacity that is less than that of the other compressor having a larger capacity. The larger capacity compressor is typically referred to as the base compressor. Specifically, compressor 102 shall be capable of compressing air at a pressure of 110 pounds per square inch (psi) and producing a volumetric flow rate capacity of 740 cubic feet per minute (CFM). Additionally, compressor 104 shall also be capable of compressing air at a pressure of 110 psi and producing a volumetric flow rate capacity of 750 CFM. Furthermore, the basic compressor 106 shall be the base compressor that is capable of compressing air at a pressure of 110 psi and producing a volumetric flow rate capacity of 1000 CFM.

The controller 118 receives signals from the compressors 102, 104, 106, the first and second pressure sensors 114, 120, and the first and/or second flow meters 110, 122, discussed in more detail below. Upon receiving the signals from the sensors, the controller 118 determines which compressors should be loaded or unloaded, if any, and sends the corresponding signals to the compressors 102, 104, 106 along lines 112, 128, 116, respectively. A possible controller for such an application could be the controller described in U.S. Pat. No. 4,502,842, which is hereby incorporated by reference. However, the controller in that patent is different than the controller of the present invention. Specifically, unlike the controller in U.S. Pat. No. 4,502,842, which is only responsive to the system pressure, the controller of the present invention is responsive to both the system pressure and the volumetric flow rate capacity.

Figure 2:
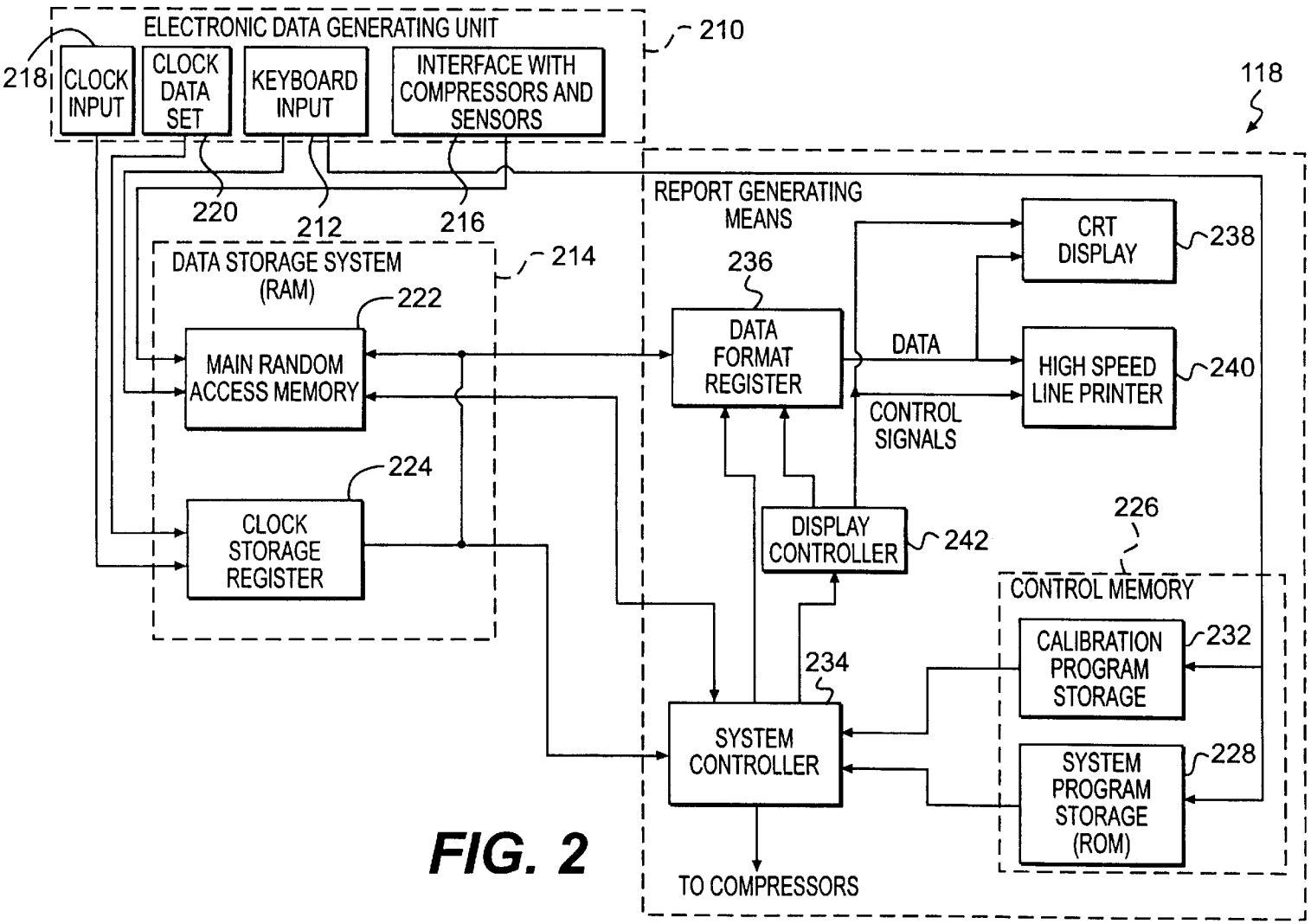
FIG. 2 is a detailed schematic diagram of the controller illustrated in FIG. 1.

Referring to FIG. 2, there is shown a detailed schematic diagram of the hardware that may be employed as the controller 118 of FIG. 1. This controller operates in accordance with a combination of data manually set into the controller along with data generated by the compressors 102, 104, 106, the first and second pressure sensors 114, 120 and the first and second flow meters 110, 122. This data is provided to the system by means of an electronic data generating unit 210, which includes a keyboard input 212 adapted to facilitate the manual input of control modes, such as a program mode, auto control mode and/or a manual control mode. All such data is provided to the data storage system 214 by means of an interface section 216 which is connected to the compressors 102, 104, 106, pressure sensors 114, 120 and flow meters 110 and 122.

Input data for the controller 118 is provided by a clock 218, which preferably constitutes a seven day, twenty four hour clock that is programmable by a clock data set section 220. The clock 218 displays time in a twelve hour AM/PM format, and has battery backup power to provide at least for eight hour protection in the event of main power failure.

The digital electrical data signals generated by the electronic data generating unit 210 are forwarded to a data storage system 214, which is designed to receive and store all of the electrical digital signals provided by both the electronic data generating unit 210 as well as other portions of the controller 118. The data storage system 214 includes a main random access memory 222 having a capacity which will be dictated by the capacity required to store substantially all of the data required for the operation of a specific multiple compressor system. The data storage system 214 may also include additional storage registers, such as a clock storage register 232, which expands the capabilities of the main random access memory 214.

The controller 118 may operate in response to various programs stored within a control memory 226, which includes a main system program storage 228 that may be supplemented by additional program storage sections 230. If the main program storage is not of sufficient capacity to contain all of the programs required for all of the various modes of operation of the controller 118, the additional program storage 232 may be employed to store a specialized program, such as the calibration program for the controller.

A system controller 234 operates in accordance with data provided from the data storage system 214 and program control from the control memory 226 to sequence the starting and/or stopping (i.e., loading and/or unloading)of the compressors 102, 104 and 106, as required. In accordance with the requirements provided by the control memory section 226, the system controller also provides control to a data format register 236 which combines data provided by the electronic data generating unit 210 into a format, which may be stored in the main random memory 222 for further control functions and which may also be selectively displayed on a display unit 238 and a printer 240. Also under the control of the control memory 226, the system controller 234 causes a display controller 242 to activate the CRT display 238 and high speed printer 240 to display data selected by the various programs for the data storage system 214.

The controller 118 operates in accordance with the relationship between the data continuously generated by the interface section 216 and the data programmed into the controller during a program mode thereof. The program mode is initiated by the keyboard 212 and may be employed to enter a daily sequence, system parameters and compressor data into the data storage system 214. The daily sequence entry is programmable by first entering a time on the clock data set 220 and then keying in either a zero or a desired target pressure on the keyboard input 212. A zero entry indicates that an idle control is called for where the controller is not activated for a period. On the other hand, if a pressure indication is keyed into the keyboard, then that pressure is to be maintained by the controller 118 in the distribution system until the next time entry.

After entering the desired set-point pressure for each phase of the sequence, the minimum and maximum set-point pressures are entered into the data storage system 224 via the keyboard 212. The minimum and maximum set-point pressures allow the compressor system to run at a relatively constant state within a range of pressures. In other words, a compressor is not unloaded or loaded to the system unless the actual pressure falls outside the range of the minimum and maximum set-point pressures. The minimum and maximum set-point pressures do not have to be equally spaced from the desired set-point pressure but are typically evenly spaced. For example, if the desired set-point pressure is 115 psi, the maximum set-point pressure may be 120 psi and the minimum set-point pressure may be 110 psi.

Similarly, desired minimum and maximum set-point volumetric flow rate capacities may be entered into the data storage system 224 via the keyboard 212. Entering such volumetric flow rate capacities allows the compressor system to be controlled according to the system's flow rates in lieu and/or in addition to the system's pressure.

Compressor data can also be programmed into the main random access memory 222 for each compressor 102, 104, and 106. As mentioned hereinbefore, each compressor has a predetermined pressure capacity and volumetric flow rate capacity. The compressor data typically includes a number for each compressor, as well as a priority value for each compressor. Specifically, compressor 102 may be assigned the number "1", and compressors 104 and 106 may be assigned the numbers "2" and "3," respectively. Accordingly, the compressor data is entered and stored in the data storage system 214. The compressor priority value is typically associated with the sequence of compressors when a fixed sequence mode of operation is to be initiated by the controller 118, such as when the controller is in the program mode. This priority value setting is also important when different types of compressors are employed in the multiple compressor system. For example, there are certain compressors that once started, should not be unloaded, such as the base compressor. In other cases, there may be a group of small compressors which are mixed with one or two extremely large compressors.

Here, it may not be desirable to start these large compressors until there is adequate demand for them or until all of the smaller compressors are running. This basically puts these compressors last in priority, but once they are started, they should not be the next compressor to be unloaded. In fact, these compressors should be the last to be unloaded after all of the other small compressors have been unloaded. This method allows the controller to use the small compressors in groups until the larger more efficient compressors are needed. Once loaded, these large compressors run as base loading machines with the smaller compressors acting as fill compressors.

Alternatively, the large compressor may run continuously, and the smaller compressor may be loaded or unloaded as the demand requires. Additionally, it may be desirable to alternate which of the smaller compressors are running in order to reduce the mechanical wear of each compressor.

As mentioned above, the compressed air demands of an industrial facility typically fluctuate throughout the day. Therefore, it is desirable to design a multiple compressor system to accommodate for industrial plant's varying demand. For example, in order to satisfy the load demand illustrated in Table 1 below, it may be desirable for a compressor system to include three compressors, all of which are rated at a pressure of 110 PSIG and each rated at an individual volumetric flow rate capacity, such as 750 SCFM, 750 SCFM, and 1000 SCFM.

TABLE 1

| Estimated Plant Load | | Compressors | | |
|---|---|---|---|---|
| (CFM) | Time | 750 CFM | 750 CFM | 1000 CFM |
| 700 | 8am–noon | X | | |
| 800 | noon–4pm | | | X |
| 1250 | 4pm–8pm | | X | X |
| 900 | 8pm–midnight | | | X |
| 600 | midnight–4am | X | | |
| 500 | 4am–8am | X | | |

Referring to Table 1, the estimated plant load between 8:00 am and 12 noon is about 700 CFM. Assuming that the plant load does not exceed 750 CFM during this period, a 750 CFM compressor is sufficient to satisfy the compressed air demand. After 12 noon, the plant requires a total of about 800 CFM of compressed air. Assuming the 750 CFM compressor is still online, it is likely to be operating at full capacity. However, the load exceeds the online volumetric flow rate capacity, thereby typically causing the compressor system pressure to decrease. Thus, the 1000 CFM compressor is required because the 750 CFM compressor is unable to satisfy the demand. Therefore, the 1000 CFM compressor is loaded to the compressor system, and then the 750 CFM compressor is unloaded.

Between 12 noon and 4:00 pm, the 1000 CFM compressor satisfies the demand. From about 4:00 pm to 8 pm, however, the estimated plant load increases to about 1250 CFM, which is slightly larger than the capacity of the 1000 CFM compressor. Again, as the load exceeds the online volumetric flow rate capacity, the system pressure decreases. Thus, a 750 CFM compressor is added to the system to produce an online volumetric pressure of 1750 CFM.

Between 8:00 pm and 12 midnight, the plant load decreases to about 900 CFM. The online volumetric flow rate capacity is 1750 CFM, and the excess volumetric flow rate capacity is 850 CFM, which is greater than the capacity of the 750 CFM compressor. Thus, the 750 CFM compressor is unloaded, thereby leaving the 1000 CFM compressor as the only loaded compressor.

At 12 midnight, the load decreases even further to about 600 CFM, thereby producing an excess volumetric flow rate capacity of about 400 CFM. Furthermore, the 600 CFM demand is less than the capacity of the 750 CFM compressors. The 1000 CFM compressor is, therefore, unloaded and the other 750 CFM compressor is loaded.

The 600 CFM demand remains for about four hours until 4 am, at which time the demand reduces to about 500 CFM. As mentioned above, rotating the compressors reduces the operating hours of a single compressor, thereby preventing excessive wear.

If the operator of the compressor system is relatively sure that the compressed air demands of the facility generally resemble the demands in Table 1, it may be desirable to program the controller to include the described sequences and operate the compressor system via the programmed mode. Although the programmed sequences will likely satisfy the majority of system requirements, there may be significant fluctuations in the system requirements during a day, thereby requiring the loading and/or unloading of compressors from the system. Thus, it may be more desirable to operate the compressor system in the auto-control mode.

Typically a pressure responsive control system has been used to control a compressor system. In other words, a pressure sensor typically senses the pressure of the compressor system and delivers a pressure signal to a controller. However, a typical pressure control system is based solely upon sensing the system's pressure.

Likewise, a typical flow control system is based solely upon sensing the volumetric flow rate capacity of the fluid within the system. More specifically, a typical flow control system includes a flow sensor that senses the volumetric flow rate capacity of the system. Upon sensing the fluctuation of the volumetric flow rate capacity of air within the system, certain compressors are appropriately loaded and/or unloaded to compensate for the varying volumetric flow rate capacity.

Controlling the compressors based solely upon the system's pressure demand or the fluid flow within the system is not the most efficient control method. Specifically, the inventors of the present have recognized that although the system may produce adequate pressure capacity, the system may produce an overabundant volume of air. Likewise, responding solely to the fluid flow requirements of the system, may create a system with a high pressure capacity. Creating an excessive pressure capacity or a surplus of fluid results in loading an unnecessary compressor to the system, thereby increasing the electrical load of the system and reducing the system's electrical efficiency.

The inventors of the present invention have discovered that it is more efficient to control the compressors upon sensing both the pressure and volumetric flow rate capacity of the fluid. Moreover, controlling the compressor system in response to sensing both the pressure and volumetric flow rate capacity of the fluid insures that the appropriate blend of compressors is loaded to the system in order to produce the most suitable pressure and volumetric flow rate capacity. In other words, the control system of the present invention loads the most appropriate compressors to the system in order to produce the most suitable pressure and volumetric flow rate capacity and minimizes the production of any excessive amounts thereof. Thus, controlling the compressors in response to both a change in pressure and a change in the volumetric flow rate capacity prevents the unwarranted utilization of electrical power, thereby producing a more efficient compressor control system.

The control system of the present invention measures the actual pressure and volumetric flow rate capacity of the fluid in the compressor system. Thereafter, the control system determines which of the compressors are operating and calculates the online volumetric flow rate capacity. The online volumetric flow rate capacity is equal to the sum of the corresponding predetermined volumetric flow rate capacities for each of the operating compressors. Upon calculating the online volumetric flow rate capacity, the control system calculates the excess volumetric flow rate capacity, wherein the excess volumetric flow rate capacity is equal to the online volumetric flow rate capacity minus the actual measured volumetric flow rate. Subsequently, the control system loads and/or unloads a compressor upon sensing whether the pressure of the fluid is less than or greater than the set-point pressure and upon determining whether the corresponding volumetric flow rate capacity for such a compressor is less than or greater than the excess volumetric flow rate capacity.

Figure 3:
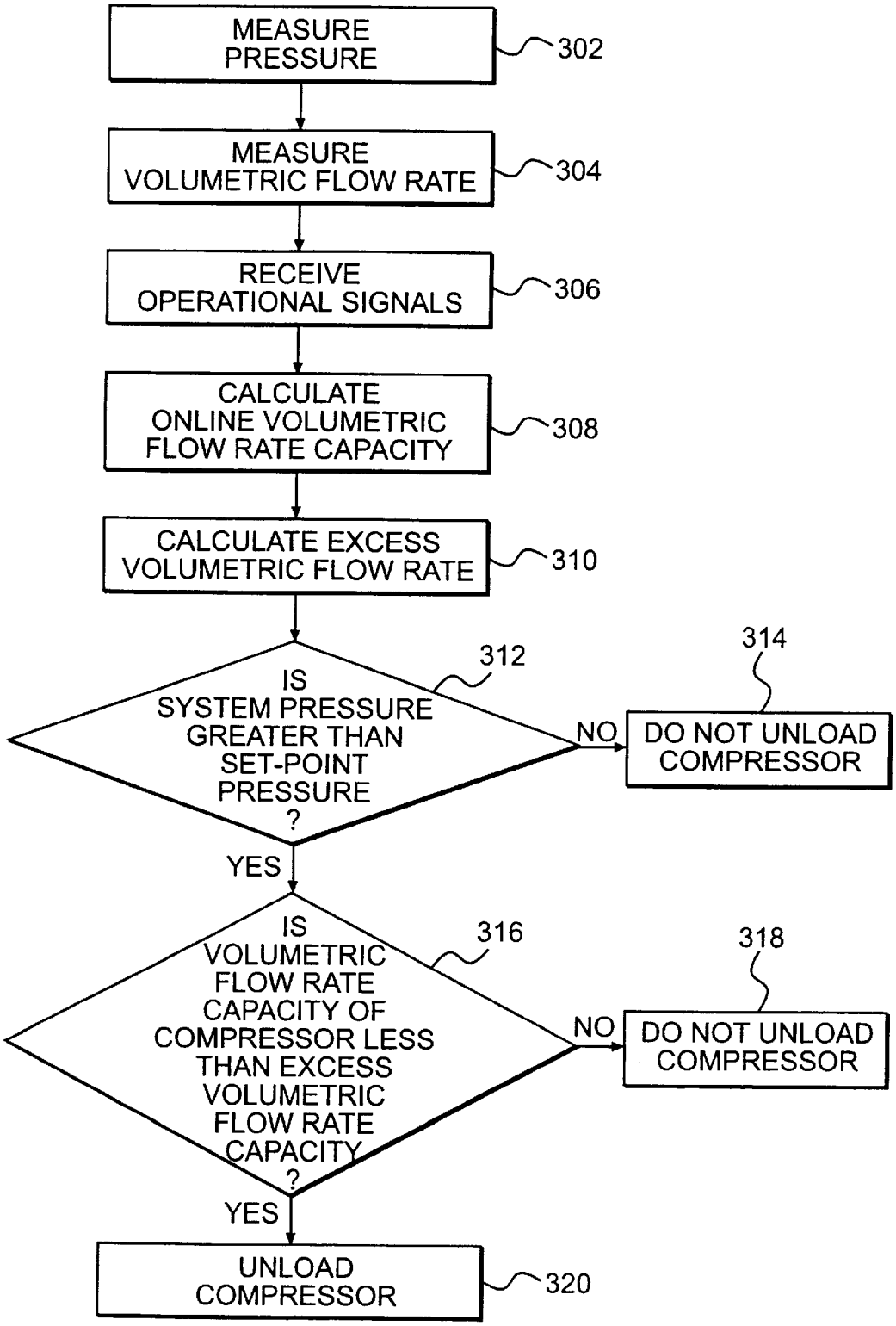
FIG. 3 is a flow chart of the control routine used to unload a compressor from the compressor system.

Referring to FIG. 3, there is shown a flow chart of the control logic used to determine whether the control system should unload a compressor. Assuming that the desired set-point pressure, along with its minimum and maximum set-point pressures, has been entered and stored in the controller 118, the first step includes measuring the actual pressure of the fluid within the compressor system, which is indicated as step 302 in FIG. 3. The second step, as indicated by item 304, includes measuring the actual volumetric flow rate capacity of the compressor system.

Referring back to FIG. 1, there are shown two sets of pressure sensors and flow meters. The first set is numbered 114 and 110, respectively and the second set is numbered 120 and 122, respectively. The first set is located upstream (i.e., before) of the flow control valve 108 and the second set is located downstream (i.e., after) of the flow control valve 108. Each sensor sends a sensor signal to the controller 118. Specifically, the first pressure sensor 114 sends a signal indicative of the pressure to the controller 118 along line 130, and the first flow meter 110 sends a signal indicative of the actual volumetric flow rate to the controller 118 along line 132. Similarly, the second pressure sensor 120 and second flow meter 122 send corresponding signals to the controller 118 along lines 124 and 126, respectively.

When sensing the pressure and volumetric flow rate of the fluid, either set or both sets of sensors may be utilized. Additionally, it may be useful to utilize one type of sensor from the first set and the other type of sensor from the second set and vice versa. However, it is preferable to control the compressor system by sensing the pressure and volumetric flow rate of the air upstream of the control valve 108. Thus it is preferable to use the first pressure sensor 114 and first flow meter 110.

Although it is possible to operate the control system of the present invention without a flow control valve 108, it is preferable to do so. The flow control valve 108 may be manually or automatically adjusted. Assuming that it is automatically adjusted, the first and second pressure sensors 114, 120 measure the pressure of the air upstream and downstream of the valve 108 and send respective signals to the controller 118. In turn, the controller 118 sends a signal along line 134, thereby opening and/or closing the valve 108 such that the pressure upstream of the valve is greater than the pressure downstream of the valve.

Continuing to refer to FIG. 1, the controller 118 also continuously receives operational signals along lines 112, 128 and 116 indicative of whether the respective compressors are running (i.e., loaded), not running (i.e., unloaded) and available. For the purposes of this disclosure the term "available" shall mean that the compressor is not loaded but is capable of being loaded. In other words, the compressor may or may not be running (or mechanically engaged) and has not had a failure. This step is illustrated in FIG. 3 as step 306.

Continuing to refer to FIG. 3, upon receiving the compressors' operating signals, the controller 118 calculates the online volumetric flow rate capacity 308 of the compressor system. Again, the online volumetric flow rate capacity is equal to the sum of the corresponding predetermined volumetric flow rate capacities for each of the loaded compressors. As mentioned above, the volumetric flow rate capacity for each compressor within the system is stored in the data storage system 214 within the controller. Therefore, upon receiving the compressor signals, the controller 118 determines which of the compressors are operating and automatically adds (i.e., sums) all of the corresponding volumetric flow rate capacities for each of the loaded compressors to produce the online volumetric flow rate capacity.

Thereafter, the controller 118 calculates the excess volumetric flow rate capacity of the compressor system 310. Again, the excess volumetric flow rate capacity is equal to the online volumetric flow rate capacity minus the actual flow rate measured by one or both of the flow meters 110, 122. Calculating the excess volumetric flow rate capacity allows the controller to determine whether to load or unload a compressor from the system based upon both the flow rate and pressure demand. Specifically, if the pressure of the fluid in the system is greater than the set-point pressure 312 and the corresponding predetermined volumetric flow rate capacity for one of the operating compressors is less than the excess volumetric flow rate capacity 316, then that compressor is unloaded from the system 320. Otherwise, a compressor is not unloaded from the system 314, 318.

When the controller 118 determines that it is necessary to unload a compressor, the controller changes the priority of the compressors such that the selected compressor is next to unload and an appropriate time delay is initiated. For example, if the compressor 102 and the compressor 104 are loaded and the actual pressure is greater than the set point pressure and the excess volumetric flow rate capacity is 750 CFM and the predetermined volumetric flow rate capacity for the compressor 104 is 750 CFM, the controller 118 will send a signal along line 128 to the compressor 104 indicating that it is the next compressor to stop within the system.

Figure 4:
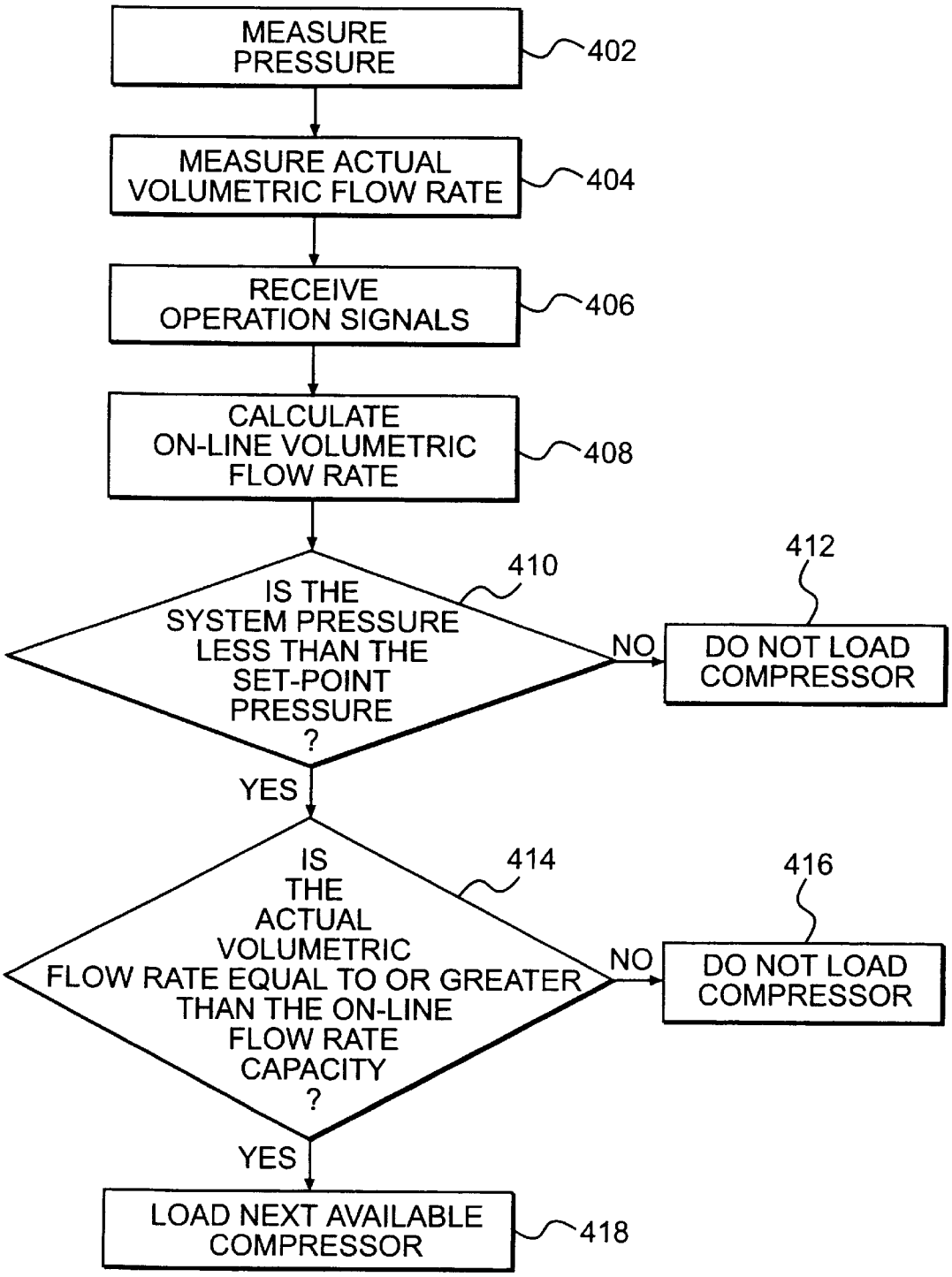
FIG. 4 is a flow chart of one embodiment of the control routine used to unload a compressor from the compressor system.

Referring to FIG. 4, there is shown a flow chart of the control logic used to determine whether the control system should load a compressor to the system. The control logic illustrated in FIG. 4 is similar to that of FIG. 3 in that the control logic of FIG. 4 includes the steps of measuring the actual pressure 402 and volumetric flow rate capacity 404 of the system, receiving operational signals 406 from the compressors and calculating the online volumetric flow rate capacity 408.

However, unlike the unloading logic of FIG. 3, the control logic of FIG. 4 does not include the step of calculating the excess volumetric flow rate capacity but includes the step of determining whether the actual system pressure is less than the set-point pressure 410. If the actual system pressure is less than the set-point pressure, a compressor is not loaded 412 to the system. If, however, the system pressure is not less than the set-point pressure, the control system then determines whether the actual volumetric flow rate capacity is equal to or greater than the online volumetric flow rate capacity 414. If the actual volumetric flow rate capacity is less than the online volumetric flow rate capacity, then a compressor is not loaded to the compressor system 416. If the system pressure is less than the set-point pressure and the actual volumetric flow rate capacity is equal to or greater than the online volumetric flow rate capacity, then the next available compressor is loaded to the compressor system 418. Thus, the loading of a compressor is a function of both the compressor system's pressure and flow rate demands.

Figure 5:
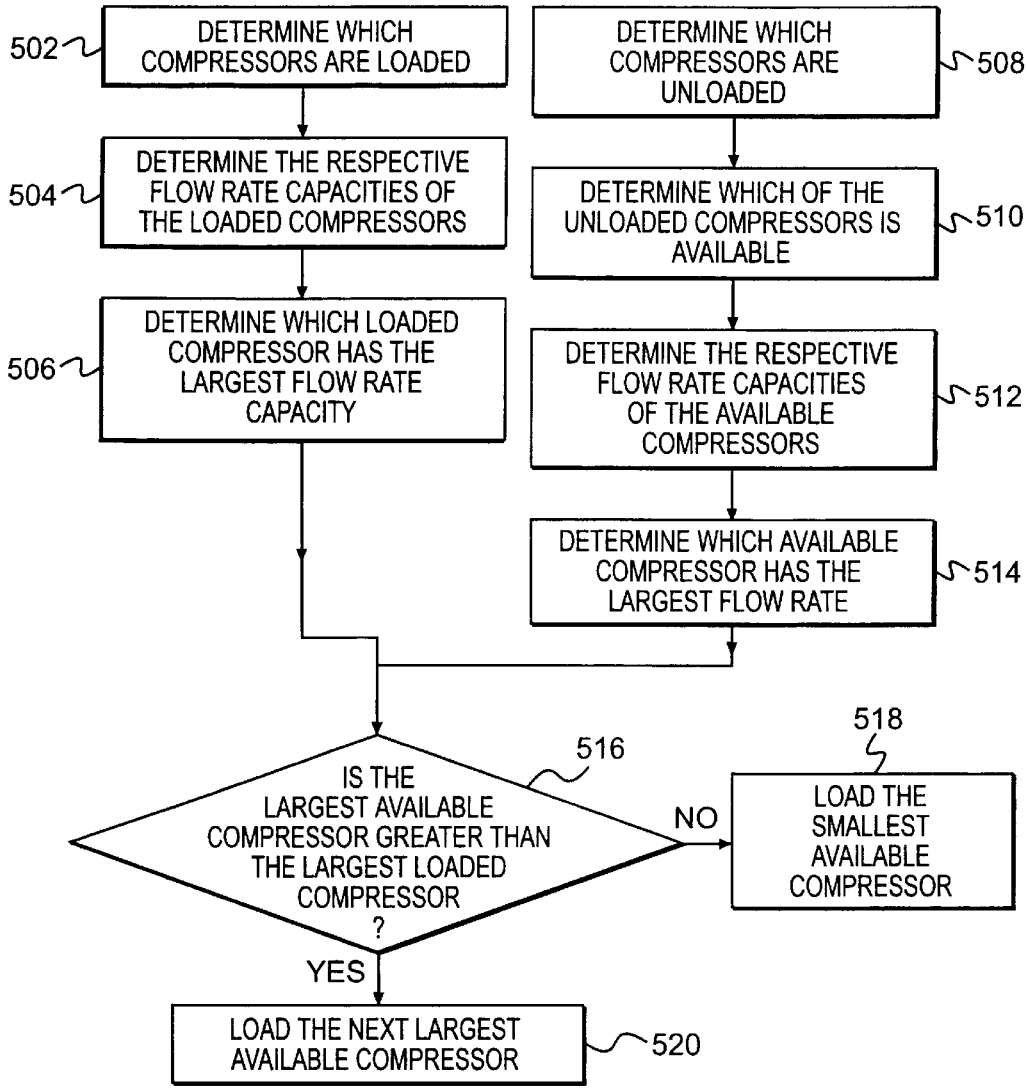
FIG. 5 is a flow chart of one embodiment of the control routine used to determine which compressor should be loaded to the compressor system.

Referring to FIG. 5, there is shown a preferred embodiment of determining which compressor to load if the system pressure is less than the set-point pressure and the actual volumetric flow rate capacity is equal to or greater than the online volumetric flow rate capacity. As mentioned above in reference to FIG. 4, the controller receives operational signals from the respective compressors. Continuing to refer to FIG. 5, upon receiving the operational signals, the controller determines which of the compressors within the compressor system are loaded 502. As also mentioned above, compressor data, such as the pressure and volumetric flow specifications, for each of the compressors within the compressor system is stored within the controller. Thus, upon determining which compressors are loaded, the controller determines the respective flow rates of the loaded compressors 504 and which of the loaded compressors produces the largest flow rate 506.

Similarly, upon receiving the operational signals, the controller determines, which compressors are unloaded 508, which of the unloaded compressors are available 510, the respective flow rates of the available compressors 512, and which of the available compressors has the largest flow rate 514. The controller compares the flow rate of the next largest available compressor to the flow rate of the largest loaded compressor 516. If the flow rate of the next largest available compressor is greater than the flow rate of the largest loaded compressor, then the next largest available compressor is loaded to the compressor system 520. Otherwise, the smallest available compressor is loaded to the system 518. As mentioned above, however, before, the largest or smallest available compressor is loaded to the compressor system, the compressor determines that both the system pressure is less than the set-point pressure and the actual volumetric flow rate capacity is equal to or greater than the online volumetric flow rate capacity.

Normally, the controller 118 operates in a programmed or auto-control mode as discussed hereinbefore. However, the controller can also be placed in a manual control mode. In a manual control, an appropriate command is keyed into the controller and all other modes of control are overridden. In other words, when a compressor is switched from auto control mode to manual mode, the controller recognizes that the compressor is unavailable. Thus, the controller will ignore all time periods stored in the clock storage register 44 for that compressor as long as it is unavailable. When the manual control mode is terminated, the controller will reinitiate the program or auto-control mode, which was interrupted by the manual mode, as if the compressor is now available.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A control system for controlling a compressor system having a plurality of compressors, wherein each of the compressors is capable of compressing a fluid at a predetermined volumetric flow rate, the control system comprising:

means for establishing a set-point pressure;

means for measuring the pressure of the fluid in the compressor system;

means for measuring the volumetric flow rate of the fluid within the compressor system;

means for determining which of the compressors are operating;

means for determining the online volumetric flow rate capacity, wherein the online volumetric flow rate capacity is equal to the sum of corresponding predetermined volumetric flow rates for each of the operating compressors;

means for determining the excess volumetric flow rate of the compressor system, wherein the excess volumetric flow rate is equal to the online volumetric flow rate capacity minus the measured volumetric flow rate; and means for unloading one of the plurality of compressors upon sensing that the pressure of the fluid in the compressor system is greater than the set-point pressure and that the corresponding predetermined volumetric flow rate for said one compressor is less than the excess volumetric flow rate.

2. The control system of claim 1 further comprising means for loading one of the plurality of compressors upon sensing that the pressure of the fluid in the compressor system is less than the set-point pressure and the measured volumetric flow rate is equal to greater than the online volumetric flow rate capacity.

3. The control system of claim 1 further comprising means for unloading an other of the plurality of compressors upon sensing that the pressure of the fluid is greater than the set-point pressure and that the corresponding predetermined volumetric flow rate for said other compressor is less than the excess volumetric flow rate.

4. The control system of claim 1 further comprising:

means for adjusting the flow of fluid downstream of the plurality of compressors; and means for measuring the pressure of the fluid in the compressor system upstream of said means for adjusting the flow of fluid downstream of the plurality of compressors.

5. The control system of claim 1 further comprising:

means for adjusting the flow of fluid downstream of the plurality of compressors; and means for measuring the volumetric flow rate of the fluid in the compressor system upstream of said means for adjusting the flow of fluid downstream of the plurality of compressors.

6. The control system of claim 1 further comprising:

means for adjusting the flow of fluid downstream of the plurality of compressors; and means for measuring the pressure of the fluid in the compressor system downstream of said means for adjusting the flow of fluid downstream of the plurality of compressors.

7. The control system of claim 1 further comprising:

means for adjusting the flow of fluid downstream of the plurality of compressors; and means for measuring the volumetric flow rate of the fluid in the compressor system downstream of said means for adjusting the flow of fluid downstream of the plurality of compressors.

8. A control system for controlling a compressor system having a plurality of compressors, wherein each of the compressors is capable of compressing a fluid at a predetermined volumetric flow rate, the control system comprising:

means for establishing a set-point pressure;

means for measuring the pressure of the fluid in the compressor system;

means for measuring the volumetric flow rate of the fluid within the compressor system;

means for determining which of the compressors are operating;

means for determining the online volumetric flow rate capacity, wherein the online volumetric flow rate capacity is equal to the sum of corresponding predetermined volumetric flow rates for each of the operating compressors;

means for loading one of the plurality of compressors upon sensing that the pressure of the fluid in the compressor system is less than the set-point pressure and that the measured volumetric flow rate is equal to or greater than the online volumetric flow rate capacity.

9. The control system of claim 8 further comprising means for loading an other of the plurality of compressors upon sensing that the pressure of the fluid in the compressor system is less than the set-point pressure and the measured volumetric flow rate is equal to or greater than the online volumetric flow rate capacity.

10. The control system of claim 8 further comprising means for unloading one of the plurality of compressors upon sensing that the pressure of the fluid is greater than the set-point pressure and that the corresponding predetermined volumetric flow rate for said compressor is less than the excess volumetric flow rate, wherein the excess volumetric flow rate is equal to the online volumetric flow rate capacity minus the measured volumetric flow rate.

11. The control system of claim 8 further comprising:

means for determining which of the plurality of compressors are loaded;

means for determining which of the loaded compressors has the largest predetermined volumetric flow rate;

means for determining which of the plurality of compressors are unloaded and available;

means for determining which of the available compressors has the largest predetermined volumetric flow rate;

means for loading the next largest available compressor upon sensing that the next largest available compressor is greater than the largest loaded compressor.

12. The control system of claim 8 further comprising:

means for determining which of the plurality of compressors are loaded;

means for determining which of the loaded compressors has the largest predetermined volumetric flow rate;

means for determining which of the plurality of compressors are unloaded and available;

means for determining which of the available compressors has the smallest and largest predetermined volumetric flow rate;

means for loading the smallest available compressor upon sensing that the largest available compressor is less than or equal to the largest loaded compressor.

13. The control system of claim 8 further comprising:

means for adjusting the flow of fluid downstream of the plurality of compressors; and means for measuring the pressure of the fluid in the compressor system upstream of said means for adjusting the flow of fluid downstream of the plurality of compressors.

14. The control system of claim 8 further comprising:

means for adjusting the flow of fluid downstream of the plurality of compressors; and means for measuring the volumetric flow rate of the fluid in the compressor system upstream of said means for adjusting the flow of fluid downstream of the plurality of compressors.

15. The control system of claim 8 further comprising:

means for adjusting the flow of fluid downstream of the plurality of compressors; and means for measuring the pressure of the fluid in the compressor system downstream of said means for adjusting the flow of fluid downstream of the plurality of compressors.

16. The control system of claim 8 further comprising:

means for adjusting the flow of fluid downstream of the plurality of compressors; and means for measuring the volumetric flow rate of the fluid in the compressor system downstream of said means for adjusting the flow of fluid downstream of the plurality of compressors.

* * * * *